US006610964B2

(12) United States Patent
Radmacher

(10) Patent No.: US 6,610,964 B2
(45) Date of Patent: Aug. 26, 2003

(54) MULTI-LAYER CERAMIC HEATER

(76) Inventor: Stephen J. Radmacher, 1753 Silverthorn Square, Pickering Ontario (CA), L1V 5M7

( * ) Notice: Subject to any disclaimer, the term of this patent is extended or adjusted under 35 U.S.C. 154(b) by 0 days.

(21) Appl. No.: 10/134,447

(22) Filed: Apr. 30, 2002

(65) Prior Publication Data

US 2002/0185485 A1 Dec. 12, 2002

Related U.S. Application Data

(63) Continuation-in-part of application No. 09/800,584, filed on Mar. 8, 2001, now Pat. No. 6,396,028.

(51) Int. Cl.[7] ..... F23Q 7/22
(52) U.S. Cl. ..... 219/270; 123/145 A
(58) Field of Search ..... 219/270, 541, 219/544, 505; 123/145 A; 338/22 R

(56) References Cited

U.S. PATENT DOCUMENTS 4,246,468 A * 1/1981 Horsma ..... 219/553
4,357,526 A 11/1982 Yamamoto et al.
4,437,440 A * 3/1984 Suzuki et al. ..... 123/145 A
4,549,071 A * 10/1985 Hatanaka et al. ..... 219/270
4,650,963 A * 3/1987 Yokoi ..... 219/270
4,682,008 A 7/1987 Masaka
4,725,711 A * 2/1988 Minegishi et al. ..... 219/270
4,742,209 A 5/1988 Minegishi et al.
4,814,581 A * 3/1989 Nunogaki et al. ..... 219/270
4,816,643 A 3/1989 Zulauf et al.
4,914,274 A * 4/1990 Hatanaka et al. ..... 219/270
5,059,768 A * 10/1991 Hatanaka et al. ..... 219/270
5,218,183 A * 6/1993 Kimata ..... 219/270
5,304,778 A 4/1994 Dasgupta et al.
5,828,810 A 10/1998 Frank et al.
5,880,432 A 3/1999 Radmacher
5,993,722 A 11/1999 Radmacher
6,037,568 A 3/2000 Hatanaka et al.
6,084,212 A 7/2000 Leigh
6,111,223 A 8/2000 Tatematsu
6,147,330 A 11/2000 Ikeda et al.
6,184,497 B1 * 2/2001 Leigh ..... 219/270
6,204,481 B1 * 3/2001 Ito ..... 219/270
6,309,589 B1 * 10/2001 Knoll et al. ..... 264/614
6,396,028 B1 5/2002 Radmacher

* cited by examiner

*Primary Examiner*—Teresa Walberg
*Assistant Examiner*—Vinod D. Patel
(74) *Attorney, Agent, or Firm*—Bereskin & Parr

(57) ABSTRACT

A multi-layer ceramic heater for igniting fuel in a diesel engine having an electrode, an insulative layer disposed over the electrode, a resistive layer disposed over the insulative layer at the tip of the heater, and a conductive layer covering the insulative layer and extending from the resistive layer over the insulative layer to the base of heater. A substantial proportion of the volume of resistive layer is located in close proximity to the tip of heater. The resistive layer has a positive temperature coefficient (PTC) of electrical resistance and preferably a portion of the electrode is variably resistive for self regulation purposes. Due to the geometry of the resistive layer and the variable resistive characteristics of the resistive layer and the electrode, the heater is well suited to applications that require quick start heating as well as good afterglow properties or prolonged heating at high temperatures.

19 Claims, 11 Drawing Sheets

MULTI-LAYER CERAMIC HEATER

This application is a Continuation-in-Part (CIP) application of application Ser. No. 09/800,584, filed on Mar. 8, 2001. Now U.S. Pat. No. 6,396,028.

FIELD OF THE INVENTION

The present invention relates to the field of electric heaters, particularly ceramic heaters as commonly used in compression type ignition engines.

BACKGROUND OF THE INVENTION

The use of heaters in operating compression type ignition or diesel engines is well known. These heaters, commonly referred to as glow plugs, are installed in the engine such that a portion of the heater extends into the combustion cylinder, thereby transferring heat to the air or fuel/air mixture contained in the cylinder.

Historically this transfer of heat has been used to ignite the fuel in the starting of engines and this is still currently done in some applications. Before starting the engine, the heater is manually activated. Once the heater reaches a predetermined temperature, the engine can be started and the heater can be shut off. Engine start-up is thereby greatly facilitated, particularly in cold climates. Continuous heating also improves the efficiency of combustion, however, and consequently efforts have been made to increase the duration of time that the heater remains active following engine start-up. These efforts have resulted in a controlled "after-glow" application in which the heater would remain active until the engine reached normal operating temperature. More recently this has been further extended to achieve prolonged or even continuous heater operation.

Extending the activation period of heaters has not been without difficulty. One major concern is the risk of overheating, namely when the engine warms up, the cooling effect on the heater is greatly reduced. An activated heater therefore will continue to build up heat, incurring the risk of reaching a temperature exceeding that which the material used to construct heater can withstand. Related to this problem is the fact that temperature conditions in the combustion chamber can fluctuate during normal operation because of, for example, changes in load experienced by the engine. In what is known as "high rpm, low load" conditions, the ratio of air to fuel drawn into the combustion chamber is much higher than required for efficient stoichiometric combustion, resulting in a significant cooling effect. Under these conditions, heaters operating continuously should increase output to compensate for the cooling effect. Thus temperature regulation against overheating and overcooling is required in heaters which operate in prolonged or continuous use applications.

The risk of overheating was particularly acute in earlier heaters constructed from metal materials. Since then ceramic has become a much more popular choice because it is able to withstand higher temperatures. Ceramic heaters can heat up more quickly, maintain a higher operating temperature, and are more resistant to corrosive elements than metal heaters. The ceramic materials selected also possess a Positive Temperature Coefficient (PTC) of electrical resistance wherein an increase in temperature results in a corresponding increase in electrical resistance. As the temperature of a PTC material increases, the resistance to the flow of the electrical current also increases. At high temperature the resistance increases so that the heater draws less current, thereby protecting itself against overheating.

There are a variety of existing heater designs which incorporate the use of ceramic materials. In one such design a filament made from a metal such as tungsten is imbedded in a ceramic cylinder. This design is described in, for example, U.S. Pat. No. 4,357,526 to Yamamoto et al. Although this design captures some of the benefits associated with ceramic materials, it is weak in terms of the integrity of the electrical circuit at high temperatures. Efficient heating depends on a reliable electrical connection between the filament and the surrounding ceramic, but metal-to-ceramic connections in which the ceramic acts as the heating element are difficult to maintain, due in part to embrittlement and ultimately decomposition of the metal. In addition, the electrical current capability of the heater is limited by the relatively small diameter of the filament. A larger filament would increase stresses on the assembly due to the differences in thermal expansion properties of ceramic and metal.

Improved ceramic heater designs exist in which the heater is constructed from ceramic materials alone, although these types of heaters also suffer from a number of disadvantages. For example, the all-ceramic heater element disclosed in U.S. Pat. No. 6,084,212 to Leigh suffers from various disadvantages associated with what is typically known in ceramics as micro-cracking. Ceramic heaters generally undergo severe thermal stresses due to rapid heating and cooling effects in an engine. Since Leigh substantially narrowed heater tip, micro-cracks which originate from the surface, grow slowly through the ceramic materials causing the narrowed tip to break off. Further, the overly thin layers utilized within the heater are prone to failure at an early stage of crack propagation since the crack only has to run a relatively short distance before becoming problematic. Due to the narrowed tip, the glow plug heater is more prone to thermal cycling because of a reduced thermal mass, which itself can rapidly accelerate stress induced cracking. Finally, in order to provide sufficient heating volume, a relatively large diameter base portion is required. A large-based heater is not always feasible due to the space allowances associated with installation hole in an engine.

The ceramic heater designs comprising separate heater and regulator elements typically use materials with different PTC characteristics for the two elements to improve the self-regulating capabilities of the heater. By selecting a ceramic for the regulator with a higher PTC than that of the heater element, a more controlled temperature profile can, in theory, be obtained. Practically, however, there are some adverse effects resulting from this design. Any temperature fluctuations in the combustion chamber must first be transmitted through the ceramic heater element before being sensed by the regulator element. This results in a delayed response which in some cases can cause the regulator to control the current flow in a manner which is opposite to what is immediately required at the end of the heater.

An additional drawback of the separate regulator and heater designs is that they typically require that the heater to have a tip with a reduced diameter. This characteristic can be observed in heater designs disclosed in, for example, U.S. Pat. No. 4,682,008 to Masaka, where the tip of the heater is narrowed in order to generate greater resistance, and accordingly a concentrated heat zone. If this is not done, the heater would generate heat along the entire length of the element and thereby consume an excessive amount of power. However, narrowing the tip reduces the surface area and overall volume of the heater element in the combustion chamber. This in turn reduces the rate of heat transfer from the heater to the air around it, which reduces the overall performance of the heater. Alternatively, an enlarged base may be employed in the above tapered heater design, but that is undesirable in the case of most engines where a larger installation hole is prohibited.

These drawbacks are overcome to some extent in heater designs comprised of a single ceramic element that provides both the heating and regulatory functions. However, typical designs still require a narrower diameter at the tip and are subject to the drawbacks associated with a narrowed tip as discussed above. Existing single element designs also contain a point of contact between the ceramic heater element and a metal member. This combination of materials positioned adjacent to each other presents significant problems. As current flows from one material to the other, the connection degrades and eventually leads to failure of the heater. In order to counteract this problem and achieve an acceptable useful life, these heaters are operated at lower power levels, which compromises the performance of the heater.

SUMMARY OF THE INVENTION

The present invention provides a heater having a tip, said heater comprising:

(a) an electrode;

(b) an insulative layer disposed over the outer surface of said electrode;

(c) a resistive layer disposed over said insulative layer such that a substantial portion of the volume of said resistive layer is disposed in close proximity to the tip of the heater; and (d) a conductive layer which is disposed over said insulative layer.

In another aspect, the present invention provides a heater having a tip, said heater comprising:

(a) an electrode comprising a first portion having a resistance that varies with temperature, a substantial portion of the volume of said first portion being disposed in close proximity to the tip of the heater;

(b) an insulative layer disposed over the surface of said electrode;

(c) a resistive layer disposed over said insulative layer; and (d) a conductive layer which is disposed over said insulative layer.

In another aspect, the present invention provides a ceramic heater comprising:

(a) a resistive heater portion; and (b) a regulatory portion coupled to said heater portion, said regulatory portion having a negative temperature coefficient of resistance for regulating the power in the heater.

In another aspect, the present invention provides a method of fabricating a heater having a tip, said method comprising the steps of:

(a) forming an electrode;

(b) forming an insulative layer and positioning it over the electrode;

(c) forming a resistive layer and positioning it over the insulative layer such that a substantial portion of the volume of the resistive layer is disposed at the tip of the heater;

(d) forming a conductive layer and positioning it over the insulative layer; and (e) slip casting the electrode, insulative layer, the resistive layer and the conductive layer to form a green body.

DETAILED DESCRIPTION OF THE PREFERRED EMBODIMENT

Figure 1:
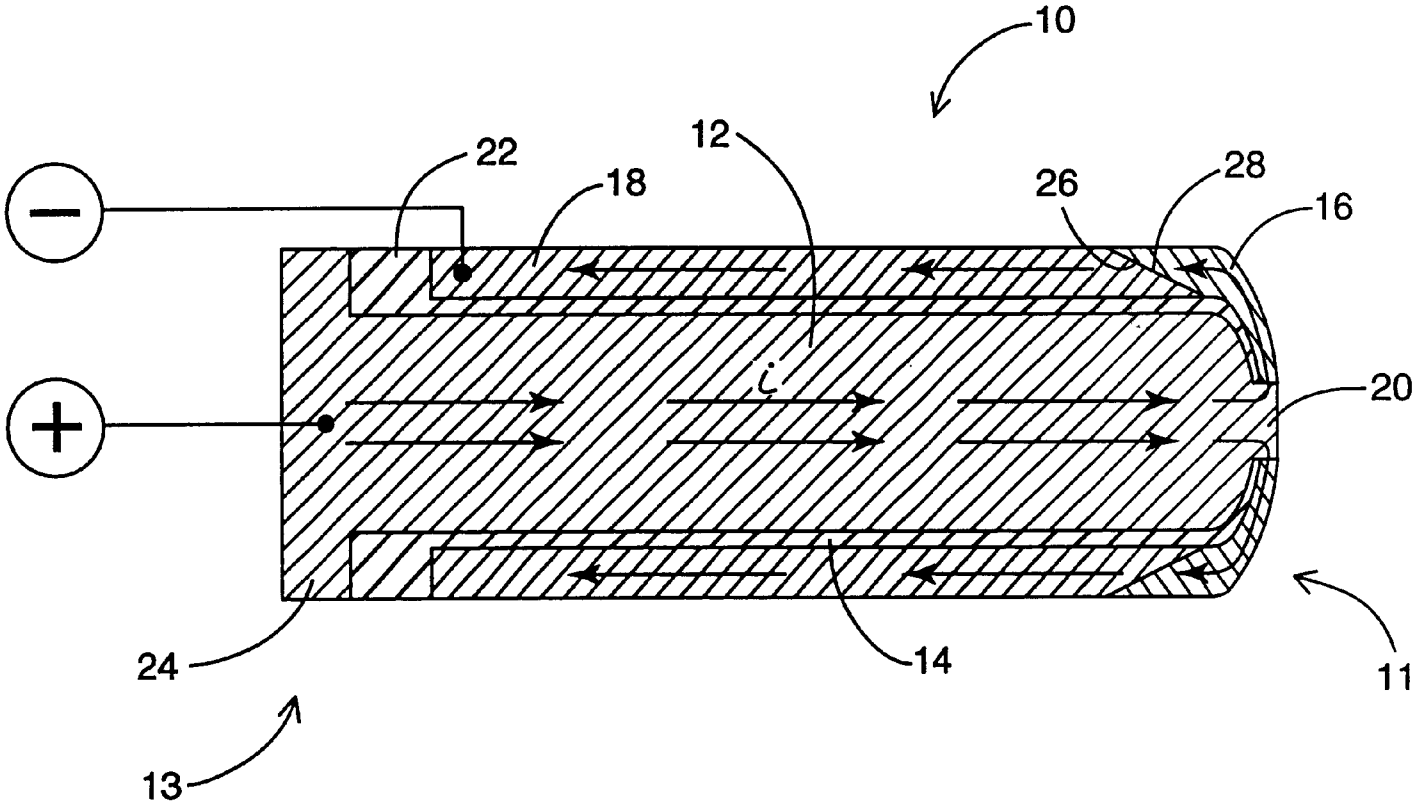
FIG. 1 is a cross-sectional view of a multi-layer ceramic heater according to a first embodiment of the present invention.

Reference is first made to FIG. 1, which shows a cross-sectional view of a multi-layer ceramic heater 10 made in accordance with a preferred embodiment of the invention having a tip 11 and a base end 13. Heater 10 is comprised of an electrode 12, an electrically insulative layer 14, an electrically resistive layer 16 disposed primarily about tip 11, and an outer electrically conductive layer 18 that extends along the length of heater 10 from resistive layer 16 to base end 13. When an operational voltage is applied across electrode 12 and conductive layer 18 (as shown by the polarity symbols in FIG. 1), electrical current flows (as illustrated by arrows in FIG. 1) through electrode 12, into resistive layer 16 at the tip of heater 10, and then through the section conductive layer 18 closed to base end 13 of heater 10.

Electrode 12 is electrically conductive and serves as an electrical anode for heater 10. Electrode 12 is manufactured from a ceramic material and has a protrusion 20 at one end which extends at the tip 11 of heater 10 and a flange 24 which extends outwards at the base end 13 of heater 10. The diameter of electrode 12 is preferably in the range of 1.2 to 2.5 millimeters. electrode 12 is manufactured from a composition of ceramic materials selected in respective proportion to have properties of an electrical conductor. Specifically, electrode 12 is made from a composition which has at least 40% volume of electrically conductive materials and up to 5% volume sintering additives. The ceramic components may include: $Al_2O_3$, $Si_3N_4$, SiC, $Al_3N_4$, $SiO_2$, $Y_2O_3$, MgO, $Zr_2O_3$, SiAlON, $MoSi_2$, $Mo_5Si_3C$, $WSi_2$, TiN, $TaSi_2$, $TiB_2$, $NbSi_2$, $CrSi_2$, WC, $B_4C$, and TaN. Additionally, methylcellulose or polyvinyl-alcohol may be used as an organic binder for these compounds.

Insulative layer 14 is made of an electrically nonconductive ceramic material and extends along the length of heater 10 over the outer surface of electrode 12. It has been determined that in order to be effective, insulative layer 14 should have a diameter in the range of 0.2 to 0.6 millimeters in order to provide an effective electrically insulative barrier between electrode 12 and conductive layer 18. Insulative layer 14 extends along the length of electrode 12 and abuts the side surface 21 of protrusion 20 of electrode 12. Insulative layer 14 also has a flange 22 which abuts the front surface 23 of flange 24. Insulative layer 14 is manufactured from a composition of ceramic materials selected in respective proportion to have electrically non-conductive properties. Specifically, insulative layer 14 is made from a composition which is at least 75% volume of electrically nonconductive materials and up to 5% volume sintering additives. The ceramic components may include: $Al_2O_3$, $Si_3N_4$, SiC, $Al_3N_4$, $SiO_2$, $Y_2O_3$, MgO, $Zr_2O_3$, SiAlON, $MoSi_2$, $Mo_5Si_3C$, $WSi_2$, TiN, $TaSi_2$, $TiB_2$, $NbSi_2$, $CrSi_2$, WC, $B_4C$, and TaN. Additionally, methylcellulose or polyvinyl-alcohol may be used as an organic binder for these compounds.

Resistive layer 16 is positioned within heater 10 such that a substantial proportion of the volume of resistive layer 16 is disposed in close proximity to tip 11 of heater 10 over insulative layer 14. Resistive layer 16 is comprised of a ceramic material having a higher positive temperature coefficient (PTC) than that of its adjoining layers, namely insulative layer 14 and conductive layer 18. Resistive layer 16 abuts the side surface 21 of protrusion 20 such that the interface between resistive layer 16 and electrode 12 allows electrical current to be conducted therethrough. Resistive layer 16 has an inclined surface 26 which abuts conductive layer 18. It has been determined that it is advantageous for resistive layer 16 to have a maximum thickness in the range of 0.5 to 1.2 millimeters, which is typically 50% of the overall available cross-sectional area for heater 10. Further, resistive layer 16 is manufactured out of a ceramic material which is designed to be electrically variable resistive, namely having up to 37% volume of electrically conductive materials that when added together have a degree of a PTC of electrical resistance, and up to 5% volume sintering additive. The ceramic components may include: $Al_2O_3$, $Si_3N_4$, SiC, $Al_3N_4$, $SiO_2$, $Y_2O_3$, MgO, $Zr_2O_3$, SiAlON, $MoSi_2$, $Mo_5Si_3C$, $WSi_2$, TiN, $TaSi_2$, $TiB_2$, $NbSi_2$, $CrSi_2$, WC, $B_4C$, and TaN. Additionally, methylcellulose or polyvinyl-alcohol may be used as an organic binder for these compounds.

Conductive layer 18 is formed over the surface of insulative layer 14 extending from inclined surface 26 of resistive layer 16. The result is that the entire surface of insulative layer 14 is covered by either resistive layer 16 or conductive layer 18. Conductive layer 18 has a front inclined surface 28 which mates with inclined surface 26 of resistive layer 16. These two inclined surfaces 26 and 28 are oriented and electrically bonded to each other so that electrical current can be conducted between conductive layer 18 and resistive layer 16 through surfaces 26 and 28 as will be understood by a person skilled in the art. It should be noted that since surfaces 26 and 28 are inclined relative to the axis of electrode 12, the increased surface area of surfaces 26 and 28 allows for a more secure electrical and mechanical connection between resistive layer 14 and conductive layer 18. Conductive layer 18 is preferably formed of ceramic material that has at least 40% volume of electrically conductive materials and up to 5% volume sintering additives so that the material is electrically conductive. The ceramic components may include: $Al_2O_3$, $Si_3N_4$, SiC, $Al_3N_4$, $SiO_2$, $Y_2O_3$, MgO, $Zr_2O_3$, SiAlON, $MoSi_2$, $Mo_5Si_3C$, $WSi_2$, TiN, $TaSi_2$, $TiB_2$, $NbSi_2$, $CrSi_2$, WC, $B_4C$, and TaN. Additionally, methylcellulose or polyvinyl-alcohol may be used as an organic binder for these compounds.

Preferably, all four layers of heater 10 are comprised of ceramic material, where the composition of the various layers differ only in the amount of conductive ceramic component (e.g. $MoSi_2$), so that the desired electrical conductivity of the various layers can be produced. Typically, heater 10 can be manufactured advantageously with a total diameter of approximately 4 millimeters. This thickness allows for optimal use of available space within a combustion chamber and allow for an efficient level of heat transfer between heater 10 and the surrounding chamber environment. In terms of longitudinal dimensions, the overall length of the resulting heated portion at tip 11 of heater 10 typically varies between 4 to 6 millimeters. This has been determined to be the most efficient length of a heater 10 tip for extension into a combustion chamber. The longitudinal length of the portion of heater 10 in between tip 11 and flange 24 is dependent (i.e. proportional) to the thickness of the installation housing hole of the engine. The longitudinal length of flange 24 at base end 13 of heater 10 is preferably is approximately 5 millimeters, since lengths in this range have been found to optimize adhesion between heater 10 and a metallic holder, as will be further described in reference to FIG. 9. The various elements of heater 10 are formed using any one of several techniques including extrusion, injection moulding etc. such techniques are common to those who are skilled in the art and further mention of these techniques will be excluded.

The various elements of heater 10 are made with such allowance as to fit together to form a green body, which is then subsequently dried then slowly heated in a vacuum atmosphere to approximately 900° C. in order to burn off the organic binders. The ceramic is subsequently heated in an inert atmosphere to higher than 1600° C. and isostatic pressure>10 megapascals is applied in order to allow for the components to be bonded and sintered into a unitary monolithic structure. The resulting ceramic will have a pore free structure in order to prevent accelerated erosion at high temperatures and be of sufficient strength to withstand thermal cycling and vibrations.

For the sake of clarity, the terms "resistive" and "variable resistive" as used in the present description should be understood to describe the characteristic of having a small degree of electrical conductivity (i.e. not electrically non-conductive nor highly electrically conductive), such that heat is generated when a suitable current is induced within such a material. The "variable resistive" portion or section as mentioned in the following descriptions is understood to describe a component that has some degree of PTC of resistance, which makes it suitable for use as a heater with self temperature regulating properties. Also, this type of material can be used as a secondary regulating device in a heater, as will be described in the context of the present invention.

Finally, in the present description "conductive" should be understood to describe a component having a greater degree of electrical conductivity than that of the variable resistive and resistive components in a circuit. For example, as described above, electrode 12 of FIG. 1 should be understood to have a lower temperature coefficient of resistance than that of its adjoining layers, namely insulative layer 14 and resistive layer 16. In other words, the conductive components are understood to generate less heat then the resistive or variable resistive components of a circuit. It should be noted that by forming the electrode of the heater of the present invention out of compositions having positive and/or negative temperature coefficients of resistance can provide additional overall operational benefits, as will further described.

Figure 2:
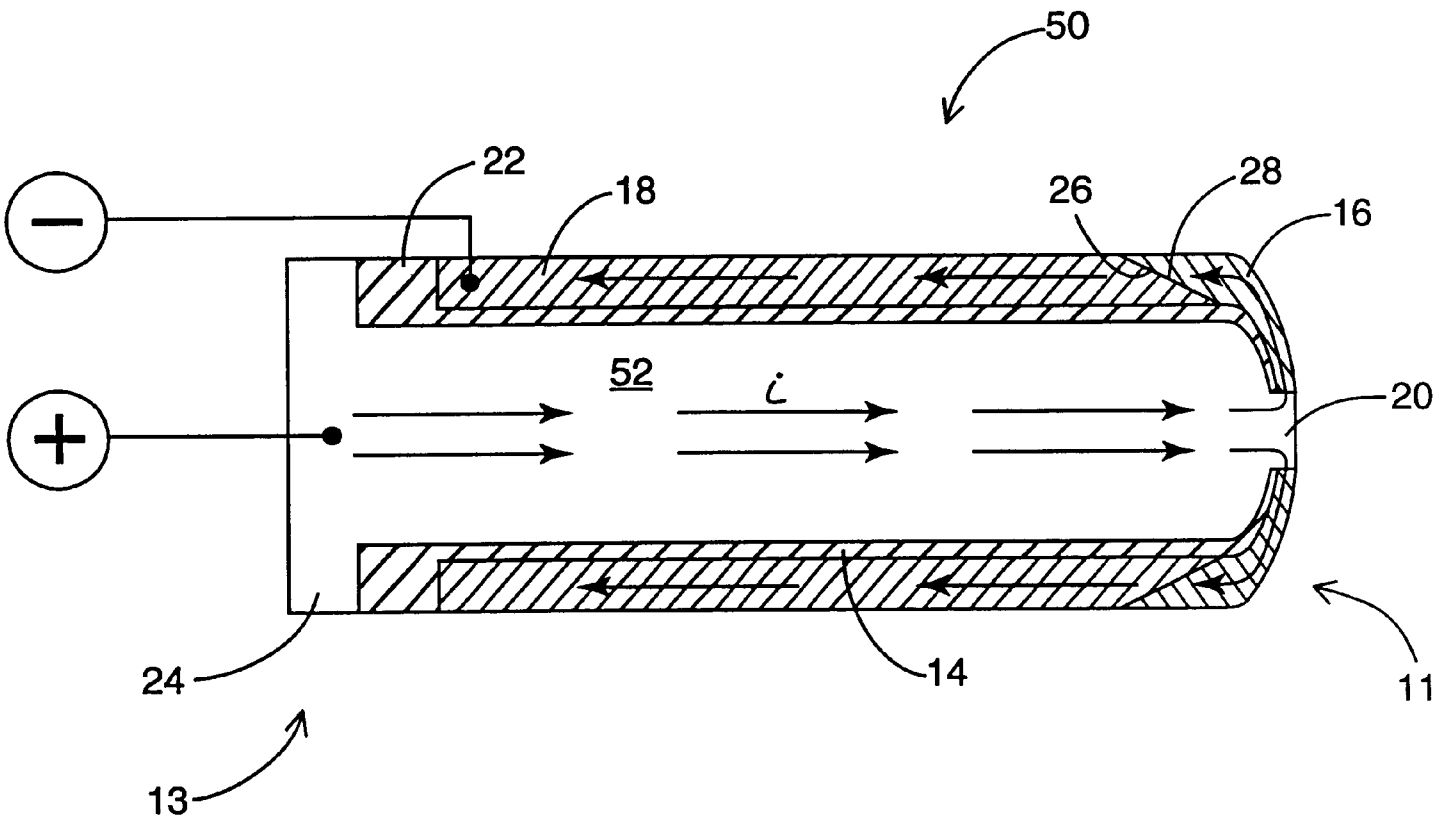
FIG. 2 is a cross-sectional view of a further embodiment of the heater of the present invention.

FIG. 2 shows a further embodiment of the present invention, designated generally as heater 50. Heater 50 contains many of the features of heater 10 and common elements between heater 50 and heater 10 will be denoted by the same numerals. In contrast to heater 10, heater 50 utilizes an electrically variably resistive ceramic rod 52 which has either a positive or negative temperature coefficient (PTC or NTC) of electrical resistance.

When an operational voltage is applied across variable resistive rod 52 and conductive layer 18, electrical current flows (as illustrated by arrows in FIG. 2) through variable resistive rod 52, into resistive layer 16, and then through conductive layer 18 to base end 13 of heater 50. Variable resistive rod 52 is manufactured out of a ceramic material which is designed to be electrically variable resistive. Specifically, variable resistive rod 52 has a 37% volume of electrically conductive materials that when added together have a degree of a positive temperature coefficient (PTC) of resistance, and up to 5% volume sintering additives. The ceramic components may include: $Al_2O_3$, $Si_3N_4$, SiC, $Al_3N_4$, $SiO_2$, $Y_2O_3$, MgO, $Zr_2O_3$, SiAlON, $MoSi_2$, $Mo_5Si_3C$, $WSi_2$, TiN, $TaSi_2$, $TiB_2$, $NbSi_2$, $CrSi_2$, WC, $B_4C$, and TaN. Additionally, methylcellulose or polyvinyl-alcohol may be used as an organic binder for these compounds.

Since variable resistive rod 52 is manufactured from variable resistive materials, heater 50 includes an additional regulatory element to assist the regulatory function of resistive layer 16. That is, when the temperature of variable resistive rod 52 is increased, the resistance therein will increase due to its PTC of resistance and accordingly current flow through variable resistive rod 52 will be reduced, in turn reducing the amount of heat generated by variable resistive rod 52. Generally, it is beneficial to design heater 10 such that it possesses a self-regulatory quality that enables it to react quickly to changes in temperature within the combustion chamber. The speed at which a variable resistive heater element responds to changes in temperature is closely related to its efficiency as a regulatory element. However, since the rod 52 of the present invention shown in FIG. 2 consists of variable resistive materials all along the length of heater 10, variable resistive rod 52 is responsive to the temperature changes that occur all along the body of heater 10 from tip 12 to base end 13.

When combustion chamber reaches a high temperature and tip 11 of heater 10 is still generating surplus heat, the current flow through variable resistive rod 52 will only be reduced according to the increase in resistance of variable resistive rod 52. Since the volume of variable resistive rod 52 is uniformly distributed along the entire length of heater 10, its resistance will be reduced according to the temperature sensed along the length of variable resistive rod 52. Since heaters are typically base cooled, there will be sections of heater 10 that are substantially lower in temperature than tip 11. These low temperature sections will influence the resistive characteristics of variable resistive rod 52 and accordingly, the resulting resistivity of variable resistive rod 52 will not be responsive to resistive layer 16, located at tip 11 of heater 10 (the region of heater 10 which is most important to regulate). Accordingly, the regulation provided by variable resistive rod 52 will not be particularly responsive to temperature changes that occur within resistive layer 16 at tip 11 of heater 10, and will only provide poor regulatory control of resistive layer 16 at tip 11 of heater 10 and variable resistive rod 52 will not operate as an efficient regulatory element within heater 10.

Figure 3:
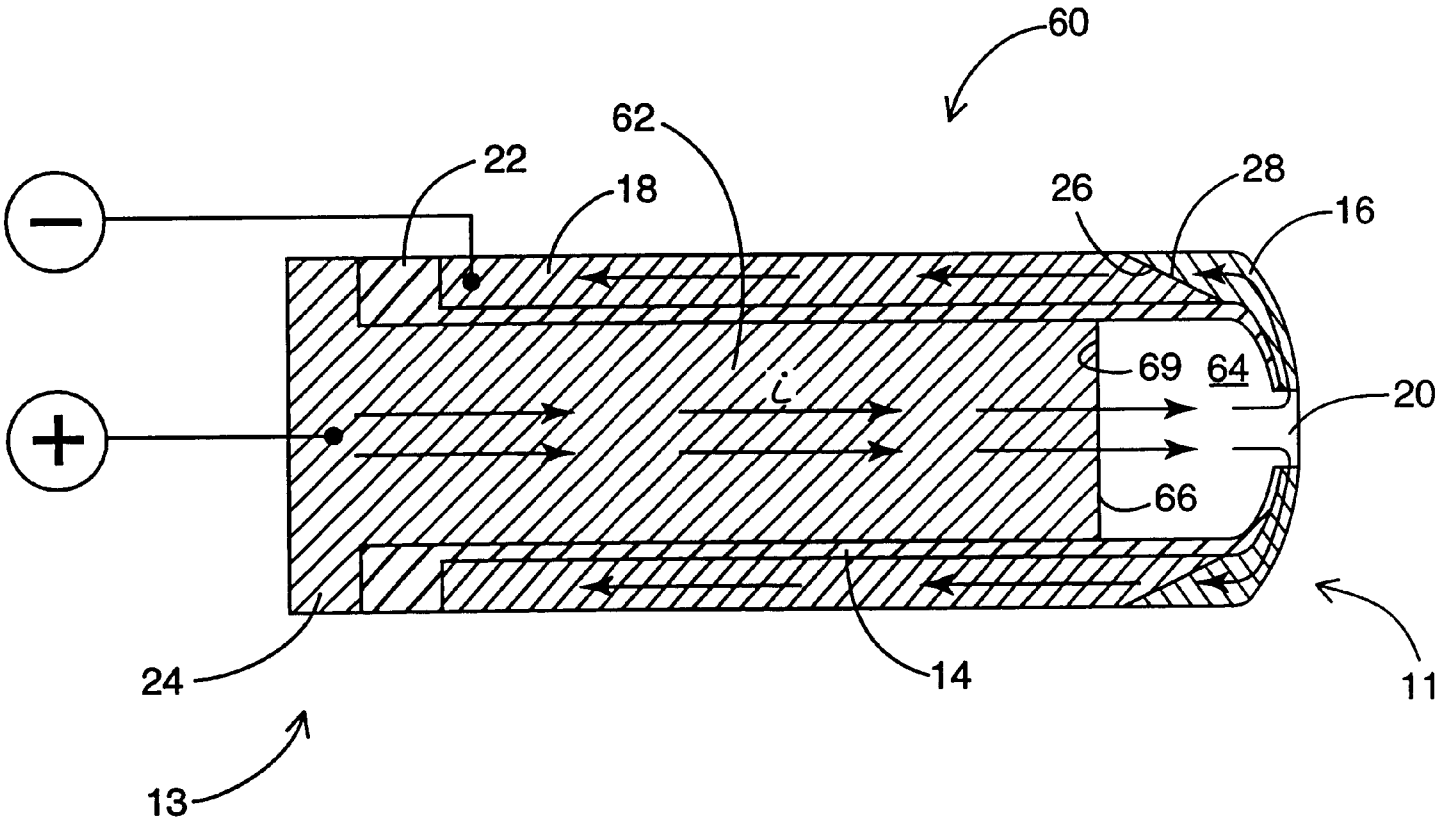
FIG. 3 is a cross-sectional view of a further embodiment of the heater of the present invention.

FIG. 3 shows an alternative embodiment of the present invention, namely heater 60 which is designed to have improved regulatory effect over heater 50. Heater 60 contains many of the features of heater 10 and common elements between heater 60 embodiment and heater 10 will be denoted by the same numerals. The difference between heater 60 and heater 10 is that a electrode 62 and a variable resistive rod 64 are used in place of electrode 12.

The front surface 66 of electrode 62 abuts a mating surface 69 of variable resistive rod 64. Surfaces 66 and 69 are oriented and electrically bonded to each other so that electrical current can be conducted between electrode 62 and variable resistive rod 64 through surfaces 66 and 69 as will be understood by a person skilled in the art. Electrode 62 extends beyond flange 22 by approximately 20 millimeters at back end 13 and variable resistive rod 62 extends back from tip 11 approximately 4 to 6 millimeters. When a voltage is applied across electrode 62 and conductive layer 18, electrical current flows (as illustrated by arrows in FIG. 3) through electrode 62, variable resistive rod 64, into resistive layer 16, and through conductive layer 18 to the base end 13 of heater 60.

Electrode 62 is manufactured out of similar ceramic materials as electrode 12 (FIG. 1) so as to be electrically conductive. However, variable resistive rod 64 is manufactured out of similar ceramic materials as rod 52 (FIG. 2). That is, variable resistive rod 64 has up to 37% volume of electrically conductive materials that when added together have a degree of a PTC of electrical resistance, and up to 5% volume of sintering additives. The ceramic components may include: $Al_2O_3$, $Si_3N_4$, SiC, $Al_3N_4$, $SiO_2$, $Y_2O_3$, MgO, $Zr_2O_3$, SiAlON, $MoSi_2$, $Mo_5Si_3C$, $WSi_2$, TiN, $TaSi_2$, $TiB_2$, $NbSi_2$, $CrSi_2$, WC, $B_4C$, and TaN. Additionally, methylcellulose or polyvinyl-alcohol may be used as an organic binder for these compounds.

The use of variable resistive rod 64 having a degree of PTC of resistance and which has a substantial proportion of its volume disposed in close proximity to the tip 11 of heater allows for more effective regulatory effect that was achievable by heater 50 of FIG. 2. Electrode 62 provides current flow from the anode of the voltage source directly to variable resistive rod 64. Since variable resistive rod 64 is located in close proximity to tip 11 of heater 10 along with resistive layer 16, variable resistive rod 64 is predominantly affected by changes in temperature that occur at the tip 11 of heater 10 (i.e. from resistive layer 16). Since variable resistive rod 64, is primarily responsive to temperature changes occurring at the tip 11 of heater 10 (i.e. within resistive layer 16), the geometric configuration of the electrode element of this embodiment efficiently regulates the overall heat provided by heater 60.

However, heater 60 may be prone to cracking, due to thermally induced stress that is further increased from differences in the thermal expansion coefficients associated with electrode 62 and variable resistive rod 64. In particular axial stress is largest in the boundary region, which resides at mating face surfaces 66 and 69. In general, the different thermal expansion coefficients associated with the various materials required (i.e. various concentrations of conductive elements) to create the requisite range of electrical properties for the various components of heater 60 produce significant differences in thermal expansion coefficients between the layers of heater 60.

Figure 4:
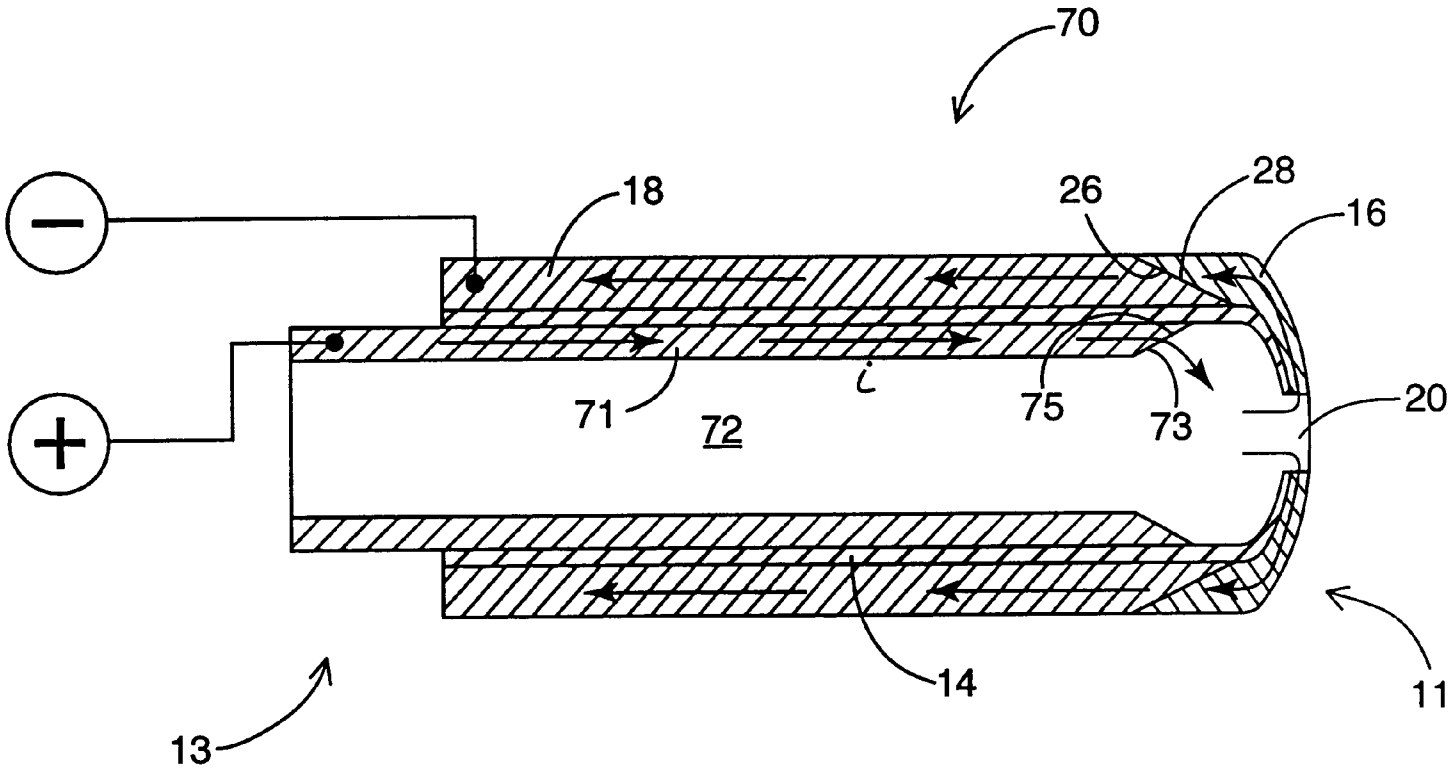
FIG. 4 is a cross-sectional view of a further embodiment of the heater of present invention.

FIG. 4 shows an alternative embodiment of the present invention, namely heater 70 that is also designed to have a similar improved regulatory effect as heater 60. In addition, the design is less prone to producing high axial stresses as those associated with heater 60 of FIG. 3. Heater 70 contains many of the features of heater 10 and common elements between heater 70 embodiment and heater 10 will be denoted by the same numerals. The difference between heater 70 and heater 10 is that the electrode element of heater 10 is comprised of an inner conductive layer 71 and a variable resistive ceramic rod 72.

Inner conductive layer 71 is formed around variable resistive rod 72 for a substantial portion of its length. Inner conductive layer 71 terminates at an inclined surface 73 which abuts a mating inclined surface 75 of variable resistive rod 72. Inclined surfaces 73 and 75 are oriented and electrically bonded to each other so that electrical current can be conducted between inner conductive layer 17 and variable resistive rod 72 through surfaces 73 and 75 as will be understood by a person skilled in the art. Surfaces 73 and 75 are formed back from tip 11 approximately 4 to 6 millimeters such that the enlarged portion of variable resistive rod 72 is present between 4 to 6 millimeters back from tip 11. Accordingly, when a voltage is applied across rod 72 and conductive layer 18, electrical current flows (as illustrated by arrows in FIG. 4) through inner conductive layer 71, into variable resistive rod 72, into resistive layer 16, through conductive layer 18 to base end 13 of heater 10.

Inner conductive layer 71 is manufactured out of ceramic materials that are designed to be electrically conductive. Specifically, ceramic material is used having at least 40% volume of electrically conductive materials and up to 5% volume of sintering additives. The ceramic components may include: $Al_2O_3$, $Si_3N_4$, SiC, $Al_3N_4$, $SiO_2$, $Y_2O_3$, MgO, $Zr_2O_3$, SiAlON, $MoSi_2$, $Mo_5Si_3C$, $WSi_2$, TiN, $TaSi_2$, $TiB_2$, $NbSi_2$, $CrSi_2$, WC, $B_4C$, and TaN. Additionally, methylcellulose or polyvinyl-alcohol may be used as an organic binder for these compounds. Variable resistive layer 72 is manufactured out of similar ceramic materials as rod 52 (FIG. 2). That is, variable resistive rod 72 has up to 37% volume of electrically conductive materials that when added together have a degree of a PTC of electrical resistance, and up to 5% volume of sintering additives. The ceramic components may include: $Al_2O_3$, $Si_3N_4$, SiC, $Al_3N_4$, $SiO_2$, $Y_2O_3$, MgO, $Zr_2O_3$, SiAlON, $MoSi_2$, $Mo_5Si_3C$, $WSi_2$, TiN, $TaSi_2$, $TiB_2$, $NbSi_2$, $CrSi_2$, WC, $B_4C$, and TaN. Additionally, methylcellulose or polyvinyl-alcohol may be used as an organic binder for these compounds.

The specific geometry of inner conductive layer 71 and variable resistive rod 72 allows for the delivery of current from the anode of the voltage source to the portion of variable resistive rod 72 which is in close proximity to the tip 11 of heater 10. Since variable resistive rod 72 is located in close proximity to tip 11 of heater 10 along with resistive layer 16, variable resistive rod 72 is predominantly affected by changes in temperature that occur at the tip 11 of heater 10 (i.e. from resistive layer 16). Since variable resistive rod 72, is primarily responsive to temperature changes occurring at the tip 11 of heater 10 (i.e. within resistive layer 16), the geometric configuration of the electrode element of this embodiment efficiently regulates the overall heat provided by heater 70.

It is noteworthy that the stress that was problematic in heater 60 of FIG. 3 is largely reduced in heater 70 of FIG. 4, due to the use of inner conductive layer 71 in place of electrode 62 in heater 60 of FIG. 3 The relatively smaller thickness of inner conductive layer 71 is less prone to producing large axial stress on the heater sections near tip 11 of heater 70 partly because as in conventionally known, stresses may be dissipated into radial directions more readily.

However, heater 70 of FIG. 4 still suffers from excessively high radial stresses which result in part from the boundary interface of materials that have distinct rates of thermal expansion. In fact, there may be an even larger net amount of stress between the surrounding sections of inner conductive layer 71 due to differences of thermal expansions. Specifically, since inner conductive layer 71 has a reduced cross section more conductive ingredients are required within conductor to provide an equivalent degree of conductivity. The largest difference of thermal expansion occurs between inner conductive layer 71 and insulative layer 14. While there is also a difference in thermal expansion coefficient between the variable resistive rod 62 and insulative layer 14 in the embodiment described in FIG. 3, high radial stress is more pronounced in heater 70 of FIG. 4.

Figure 5:
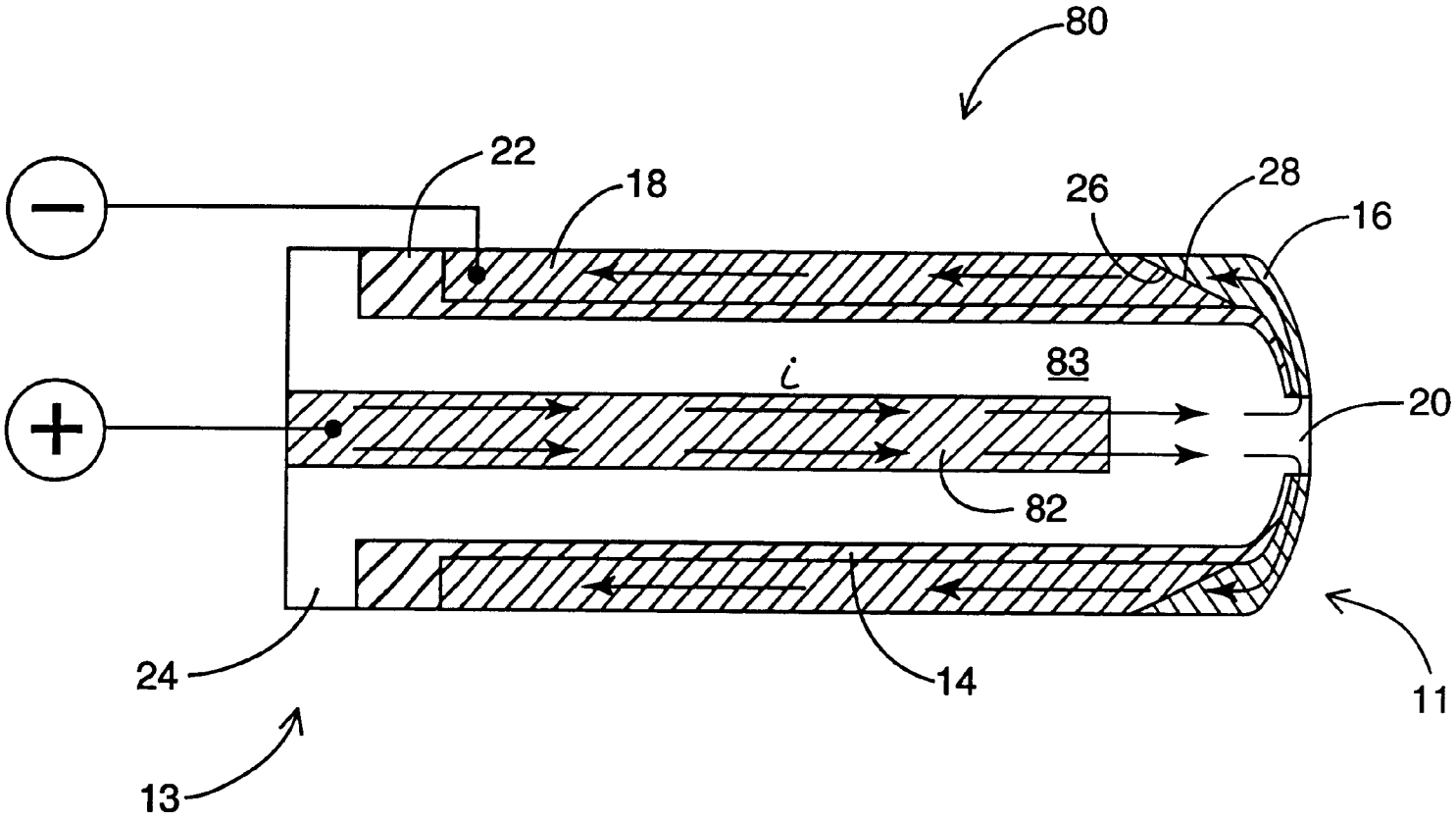
FIG. 5 is a cross-sectional view of a further embodiment of the heater of present invention.

FIG. 5 shows another embodiment of the present invention, designated generally as heater 80. Heater 80 contains many of the same features of heater 10, and common elements between heater 80 and heater 10 will be denoted by the same numerals. In the present embodiment a electrode shaped section 82 imparts less axial stress near the end of the heater because of having reduced thickness and dissipates stress in a similar manner as the inner conductive layer 71 of heater 70 of FIG. 4. Additionally, radial stress that was problematic in association with conductive layer 71 and insulative layer 14 of heater 70 of FIG. 4 has largely been eliminated in the present embodiment. The main difference between heater 80 and heater 10 is that the electrode element is comprised of a conductive core 82 and a variable resistive rod 83 having a tubular opening therein.

Variable resistive rod 83 is formed around conductive core 82 such that the inner surface of the tubular opening within variable resistive rod 83 abuts the outer surface of variable resistive rod 82. These surfaces are electrically bonded to each other so that electrical current can be conducted between conductive core 82 and variable resistive rod 83 as will be understood by a person skilled in the art. electrode 82 serves as an anode such that when a voltage potential is applied across conductive core 82 and conductive layer 18, electrical current flows (as illustrated by arrows in FIG. 5) through conductive core 82, variable resistive rod 83, into resistive layer 16, and then back through conductive layer 18.

Conductive core 82 is made to be electrically variable resistive, having up to 37% volume of electrically conductive materials that when added together have a degree of a PTC of electrical resistance, and up to 5% volume sintering additives, comprising ceramic materials that may include: $Al_2O_3$, $Si_3N_4$, SiC, $Al_3N_4$, $SiO_2$, $Y_2O_3$, MgO, $Zr_2O_3$, SiAlON, $MoSi_2$, $Mo_5Si_3C$, $WSi_2$, TiN, $TaSi_2$, $TiB_2$. Additionally, methylcellulose or Polyvinyl-alcohol may be used as an organic binder. Variable resistive layer 83 is manufactured out of similar ceramic materials as rod 52 (FIG. 2) rod 64 (FIG. 3), and rod 72 (FIG. 4), and likewise has up to 37% volume of electrically conductive materials that when added together have a degree of a PTC of electrical resistance, and up to 5% volume of sintering additives. The ceramic components may include: $Al_2O_3$, $Si_3N_4$, SiC, $Al_3N_4$, $SiO_2$, $Y_2O_3$, MgO, $Zr_2O_3$, SiAlON, $MoSi_2$, $Mo_5Si_3C$, $WSi_2$, TiN, $TaSi_2$, $TiB_2$, $NbSi_2$, $CrSi_2$, WC, $B_4C$, and TaN. Additionally, methylcellulose or polyvinyl-alcohol may be used as an organic binder for these compounds.

The specific geometry of conductive core 82 and variable resistive rod 83 allows for the delivery of current from the anode of the voltage source to the portion of variable resistive rod 83 which is in close proximity to the tip 11 of heater 10. Since variable resistive rod 83 is located in close proximity to tip 11 of heater 10 along with resistive layer 16, variable resistive rod 83 is predominantly affected by changes in temperature that occur at the tip 11 of heater 10 (i.e. from resistive layer 16). Since variable resistive rod 83, is primarily responsive to temperature changes occurring at the tip 11 of heater 10 (i.e. within resistive layer 16), the geometric configuration of the electrode element of this embodiment efficiently regulates the overall heat provided by heater 80.

Figure 6A:
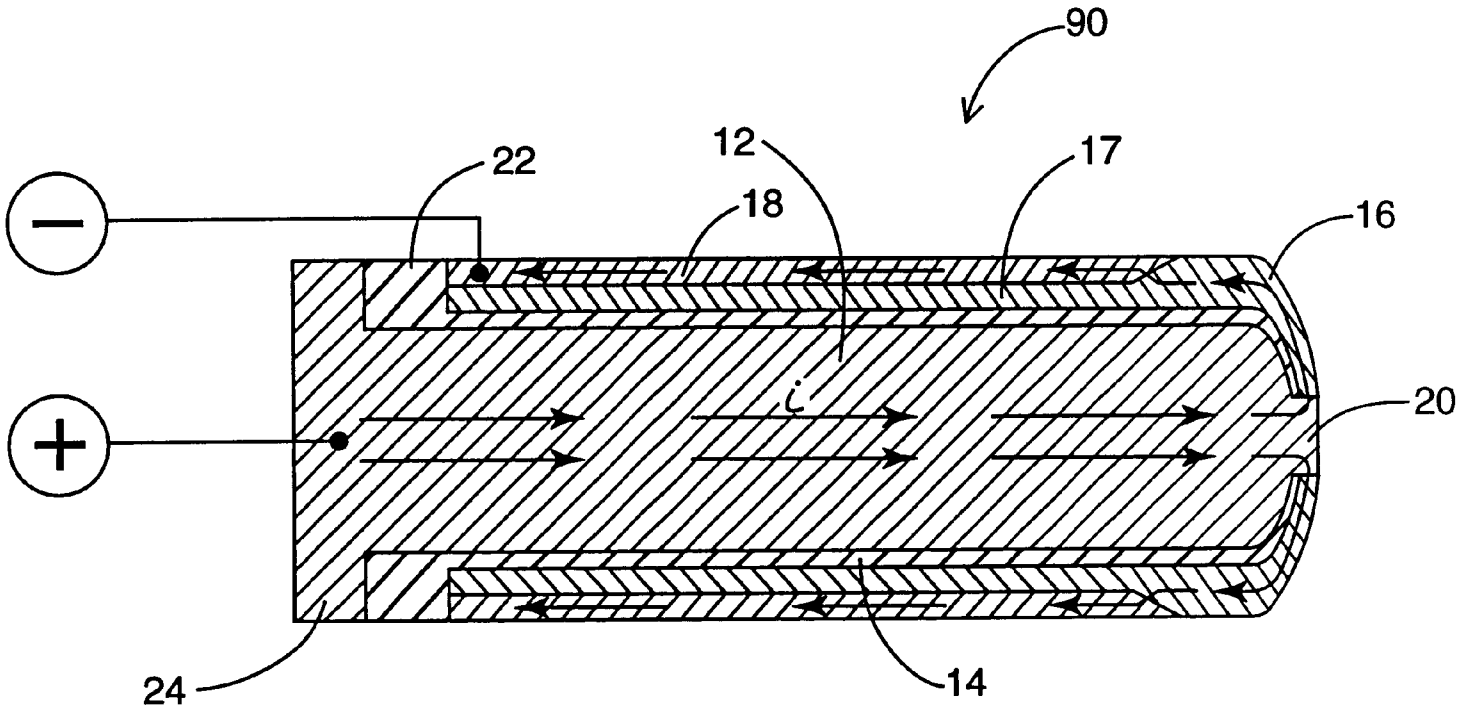
FIG. 6A is a cross-sectional view of a further embodiment of the heater of present invention.

FIG. 6A shows another embodiment of the present invention, designated generally as heater 90. Heater 90 contains many of the features of heater 10, and common elements between heater 90 and heater 10 will be denoted by the same numerals. The main difference between heater 90 and heater 10 is that a resistive sleeve 17 is positioned over insulative layer 14 back along the body of heater 10 to the flange 22 of insulative layer 14.

While the above-noted advantages of locating resistive elements in close proximity to the tip 11 of heater 10 are not as apparent in this embodiment, the specific geometrical configuration has other benefits. First, the use of a continuous strip of resistive material, namely resistive sleeve 17 and resistive layer 16 allows for certain manufacturing advantages since the layers can be easily created using conventional manufacturing methods. Further, this configuration provides for a more mechanically and thermally robust interface between insulative layer 14 and conductive layer 18.

Further, it should be understood that due to the differences of the thermal expansion coefficients of conductive layers 18 and insulative layers 14 of heaters 10, 50, 60, 70, and 80, stresses are particularly high in the interface regions between these layers. Since resistive sleeve 17 of heater 90 of FIG. 6A has a coefficient of thermal expansion that resides roughly in between that conductive layer 18 and insulative layer 14, resistive sleeve 17 provides a type of "buffer zone" in which the stress due to the coefficient of thermal expansion mismatch between the layers may be substantially reduced.

Figure 6B:
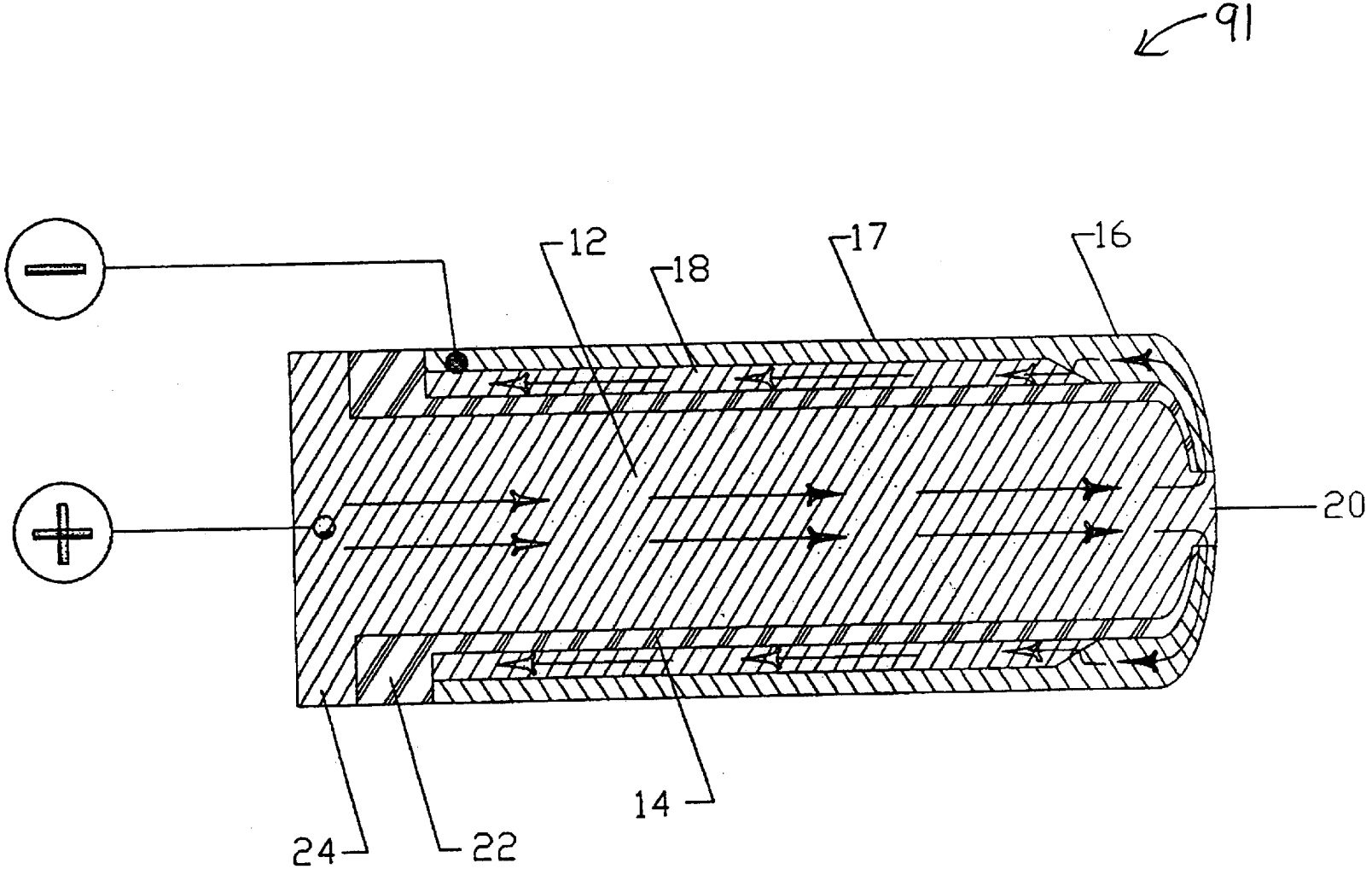
FIG. 6B is a cross-sectional view of a further embodiment of the heater of present invention.

FIG. 6B shows another embodiment of the present invention, designated generally as heater 91. This design is a variant of the basic design of FIG. 6A. Heater 91 contains many of the features of heater 10, and common elements between heater 91 and heater 10 will be denoted by the same numerals. The main difference between heater 91 and heater 10 is that resistive sleeve 17 is positioned over insulative layer 14 and conductive layer 18 back along the body of heater 10 to the flange 22 of insulative layer 14. As shown in FIG. 6B, the design is basically the same as FIG. 6A except that resistive sleeve 17 instead covers conductive layer 18 forming the outer surface. As shown in FIG. 6B, the conductive layer 18 positioned adjacent to insulative layer 14 does not benefit from reduced stress due to having a larger coefficient of thermal expansion mismatch as compared to the design of FIG. 6A. Accordingly, the design of FIG. 6A is preferred. However, in either case, both designs would still have the same advantages of permitting the use of conventional manufacturing methods. Therefore, either design could be used.

Ceramic heater 10 can be manufactured through a series of conventionally understood fabrication steps. First, five ceramic compositions are prepared, namely:

| Composition | Property | Components |
|---|---|---|
| Composition A | electrically conductive | at least 40% volume of electrically conductive materials and up to 5% volume sintering additives, comprising ceramic materials that may include: $Al_2O_3$, $Si_3N_4$, SiC, $Al_3N_4$, $SiO_2$, $Y_2O_3$, MgO, $Zr_2O_3$, SiAlON, $MoSi_2$, $Mo_5Si_3C$, $WSi_2$, TiN, $TaSi_2$, $TiB_2$, $NbSi_2$, $CrSi_2$, WC, $B_4C$, and TaN. Additionally, methylcellulose or polyvinyl-alcohol may be used as an organic binder. |
| Composition B | electrically conductive | at least 40% volume of electrically conductive materials and up to 5% volume sintering additives as discussed above. |
| Composition C | electrically insulative | at least 75% volume of electrically nonconductive materials and up to 5% volume sintering additives as discussed above. |
| Composition D | electrically variable resistive | up to 37% volume of electrically conductive materials that when added together have a degree of a positive temperature coefficient (PCT) of electrical resistance, and up to 5% volume sintering additives, as discussed above. |
| Composition E | electrically variable resistive | up to 37% volume of electrically conductive materials that when added together have a degree of a positive temperature coefficient (PTC) of electrical resistance, and up to 5% volume sintering additives, as discussed above. |

As illustrated in the table and in consideration of the various embodiments of the present invention shown in FIGS. 1 to 6, the various ceramic sections discussed above are formed using the above mixtures along with one of several techniques including extrusion, injection moulding and other techniques well known to those skilled in the art. Specifically, outer layer 18 is manufactured from composition B, resistive layer 16 is manufactured from composition D, insulative layer 14 is manufactured from composition C. Further, composition A is used for electrode 12 (FIG. 1), electrode 62 (FIG. 3), inner conductive layer 71 (FIG. 4), and conductive core 82 (FIG. 5). Composition E is used for variable resistive rod 64 (FIG. 3), variable resistive rod 72 (FIG. 4) and variable resistive rod 83 (FIG. 5).

The various elements of heater 10 are made with such allowance as to fit together to form a green body, as conventionally known. The green body is then subsequently dried then slowly heated in a vacuum atmosphere to approximately 900° C. in order to burn off the organic binders. The ceramic is subsequently heated in an inert atmosphere to higher than 1600° C. and isostatic pressure>10 megapascals is applied in order to allow for the components to be bonded and sintered into a unitary monolithic structure. The resulting ceramic will have a pore free structure in order to prevent accelerated erosion at high temperatures and be of sufficient strength to withstand thermal cycling and vibrations.

As previously discussed, it is advantageous for a heater to have the ability to efficiently self-regulate the amount of heat produced by the unit. In order for a heater to be self-regulating in an effective manner, the device must be capable of producing a sufficiently variable resistance, thereby providing a sufficiently large range of power so that the output power can closely track the temperature of the heater within a narrow range. Once way of determining whether the variable resistive elements are such that the heater is efficiently tracking the temperature of the heater is to consider the power versus time profile of the heater that occurs as an temperature equilibrium point is reached within the system.

Figure 7:
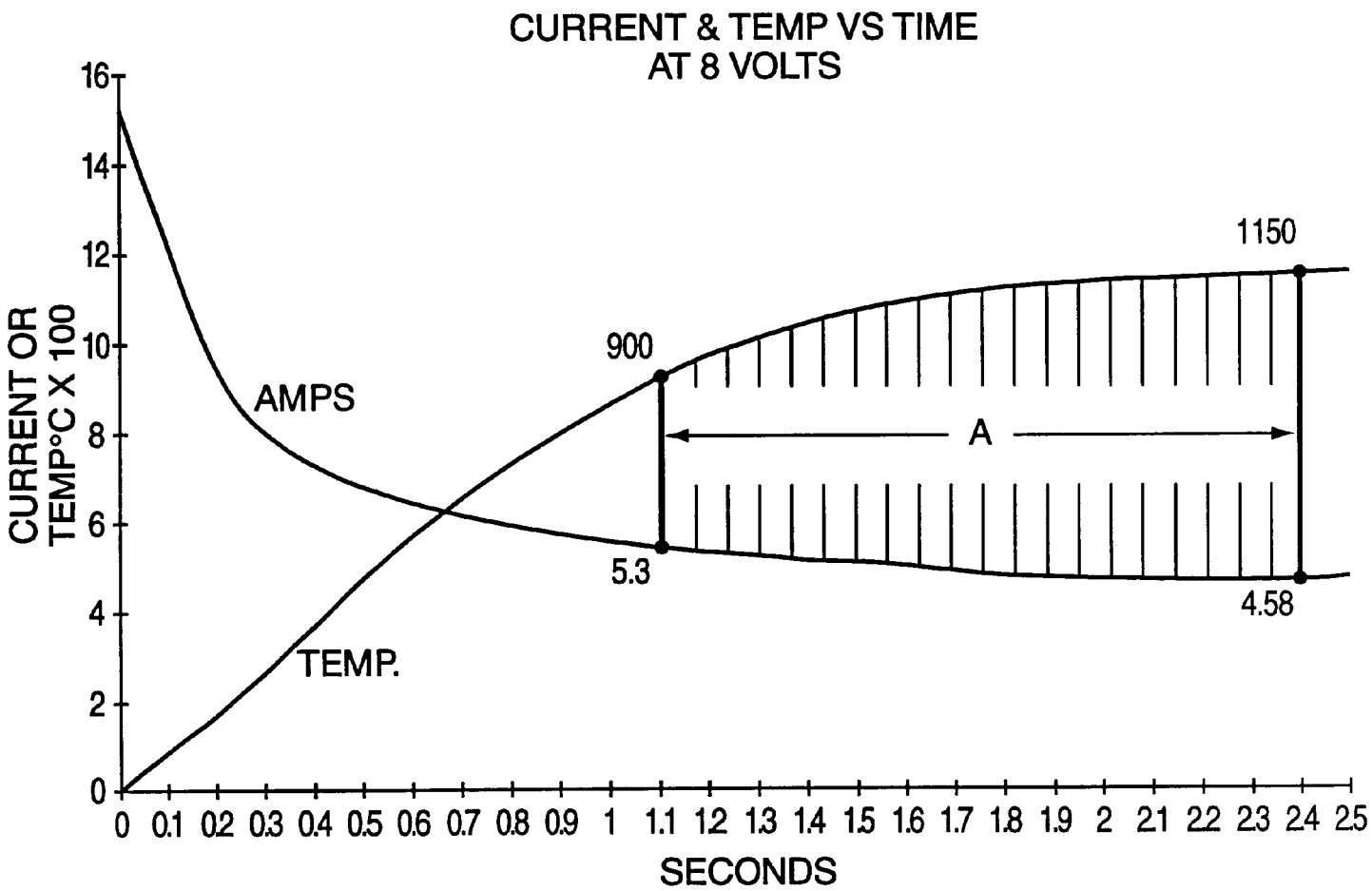
FIG. 7 is a graph showing the temperature and current relationship within the heater of one embodiment of the present invention.
Figure 8:
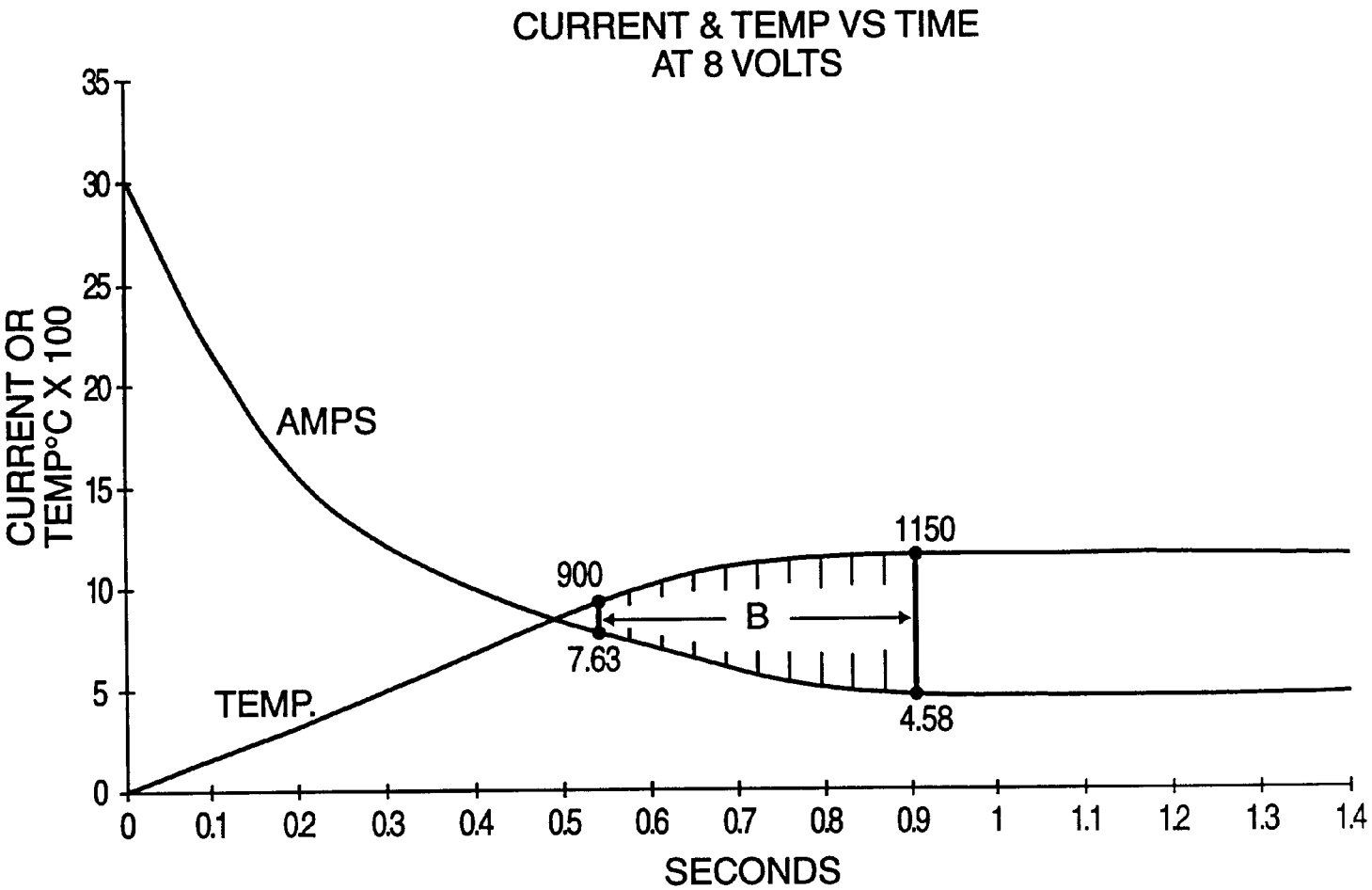
FIG. 8 is a graph showing the temperature and current relationship within the heater of another embodiment of the present invention.

FIGS. 7 and 8 are graphs which illustrates the results when a constant 8 volt voltage potential is applied across the electrode 12 and conductive layer 18 of heater 10 of FIG. 1 and across the inner conductive layer 71 and the conductive layer 18 of heater 70 of FIG. 4, respectively. Since heater 10, does not utilize any PTC elements other than resistive layer 16 and since heater 70 of FIG. 4 utilizes the variable resistive rod 72, the comparison between the current and temperature characteristics illustrates the difference between using a single PTC element and using a dual PTC element (i.e. at the tip as well as within the body of the heater). It should be noted that the specific models of heater 10 and heater 70 that were tested had the same electrical resistance at the equilibrium temperature of 1150° C., that they were selected to have equivalent heater mass and volume and that they were tested at a constant equal applied voltage of 8 volts.

Specifically, FIG. 7 illustrates the amount of current (in amperes) flowing through electrode 12 of heater 10 and the temperature (in ° C.) of resistive layer 16 at the tip 11 of heater 10 over a period of time (in seconds). FIG. 8 illustrates the amount of current (in amperes) flowing through variable resistive rod 72 of heater 70 and the temperature (in ° C.) of resistive layer 16 at the tip 11 of heater 70 over a period of time (in seconds). As illustrated in FIGS. 7 and 8, it has been determined that heaters of the present invention approach steady state temperature and power at a relatively rapid rate from a "coldstart" condition. Accordingly, the heaters of the present invention are well suited to applications that require quick start heating.

Of particular interest for temperature regulation is the amount of the current that occurs in the latter stage of heat up, or during what is conventionally known as a "useful temperature range" for glow plug heaters. It has been determined that heaters 10 and 70 enter into this range at approximately 250° C. below the temperature/ power equilibrium. As shown in FIG. 7 (in respect of heater 10 of FIG. 1), range A occurs between 900° C. to 1150° C. and has a corresponding current range of 5.3 to 4.58 amperes. This indicates a 0.72 amp differential and a 1.4 second ramp up to 1150° C. within this range. The time period may be shortened and more power made available using dual PTC heater 70 of FIG. 4, as shown in a comparable performance graph of FIG. 8. FIG. 8 illustrates the characteristics of heater 70 in a comparable range B which experiences the same temperatures between 900° C. to 1150° C. with a corresponding current range of 7.63 to 4.58 amperes. This indicates a 3.05 amp differential and a 0.35 second ramp up to 1150° C. Therefore, the latter dual PTC heater design is substantially better for temperature regulation than the single PTC design, particularly at high temperatures.

The dual heater design of heater 70 suffers from some difficulties as well, in that the starting current of 30 amperes may be too high for typical vehicle control systems. One solution is to regulate the voltage or limit the current by external means for a prescribed time at the start of heating. In practice, conventional timed power limiting apparatus is typically expensive therefore this method is not always practical. However, the present invention lends itself to other simpler means of limiting power at start up. Additional regulation can be achieved though the use of compositions with a negative temperature coefficient of resistance (NTC) in place of one or more of the conductive sections 12, 18, 62, 71, and 82, in the heaters 10, 50, 60, 70, 80 and 90 previously described (i.e. in FIGS. 1, 2, 3, 4, 5 and 6). In contrast with PTC compositions, the resistance of NTC compositions dramatically decreases with an increase in temperature, and accordingly NTC compositions can be used to initially restrict the heater's power during the start up period. NTC compositions can be manufactured as conventionally known through the careful selection of certain ceramic materials such as SiC, $Zr_2O_3$, $Y_2O_3$, WC, $B_4C$, TaNi, TiN, $WSi_2$, $Si_3N_4$.

It should be understood that NTC conductor sections should be incorporated into heaters 10, 50, 60, 70, 80, and 90 of the present invention in accordance with particular design requirements. First, the conductor must be considerably more conductive than the PTC heater components near the later stages of heating i.e. 900 to 1050° C. This is necessary in order for the NTC properties of the conductor not to interfere with the desired temperature regulating properties of the PTC heater/s as well as to limit the conductor itself from heating in the base portion of the device. Second, the conductor must be less conductive at the early stage of heating (i.e. preferably well below 900° C. thus, limiting the start up current to predetermined level). Accordingly, in operation, the heater's power would initially be restricted by the NTC conductor and progressively lessen with an increase of temperature until which point the PTC heater sections alone would remain effective as the most resistive thereby controlling the final temperature of the heater.

Figure 9:
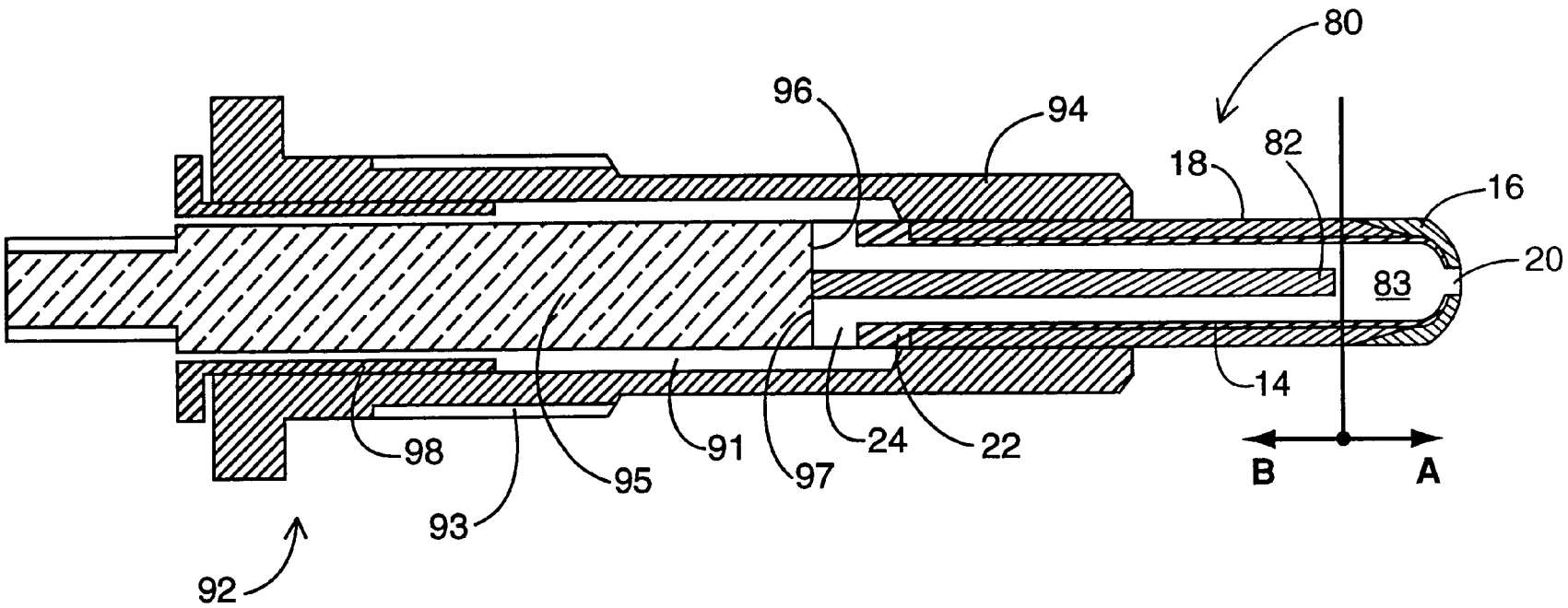
FIG. 9 is a cross-sectional view of a glow plug incorporating the heater of the present invention.

Referring now to FIGS. 4 and 9, heater 80 is positioned and bonded within a holder 92 in order to contact metal electrode portion 95 which extends from the back of holder 92. Electrode portion 95 is located within a cavity 91 of holder 92, and has a front surface 96 which is adapted to couple in a electrically effective manner to the extended back surface 97 of conductive core 82 and flange 24 of variable resistive rod 83. Front surface 96 of electrode portion 95 is bonded to back surface 97 using conventionally known materials (e.g. active metal braising metals) for joining ceramic to metal. Typically, such a material contains Ti, Cu, Ni, or other such base metals. The braising process can be preformed in a vacuum furnace and heated to above 600° C. The metal holder 92 can be made of steel or other metal that is suitable for braising in this manner and has a cavity 91.

Electrode portion 95 can be made of copper or other metals that are suitable for braising in the above manner, as conventionally known. Electrode portion 95 can then secured within holder 92 using an insulating tubular layer 98 to secure and prevent electrode portion 95 from having electrical contact with holder 92. Insulator 98 can be further secured within holder 92 using a bonded organic sealant, glue, etc. and/or may also be crimped on by the metal holder 92. Insulator 98 can be made of plastic, resin, or other suitable materials. Housing 92 also includes a clamping layer 94 for providing electrical contact between conductive layer 18 of heater 80 and holder 92. Holder 92 also has a threaded portion 93 for threaded connection to the engine housing.

It should be noted that as shown in FIG. 9 for heater 80, the region indicated as "A" has been designed to be manufactured out of a material with a higher PTC of resistance than the region indicated as "B". Further, each of heater 60, 70, 80 and 90 also has a similar PTC of resistance profile. In all cases, since current flows through the high PTC material which is located in close proximity to tip 11 of heater 10, the variable resistive element which is located within the heater body is predominantly affected by changes in temperature that occur at the tip 11 of heater 10 (i.e. from resistive layer 16). Since variable resistive rod 83, is primarily responsive to temperature changes occurring at the tip 11 of heater 10 (i.e. within resistive layer 16), the various geometric configurations of the electrode element of these embodiment allow for the efficient regulation of the overall heat provided by the various heaters 60, 70, 80 and 90.

Referring now to FIGS. 1 to 6B, in each type of heater discussed, conductive layer 18 may be mounted within holder 92 generally as shown in FIG. 9 and attached to the negative outlet of a voltage source. Alternatively, conductive layer 18 of the various heaters discussed may be connected to an electrical ground in which case the particular device anode (i.e. namely electrode 12 in FIG. 1, variable resistive rod 52 in FIG. 2, electrode 62 in FIG. 3, conductive layer 71 in FIG. 4, conductive core 82 in FIG. 5, and electrode 12 in FIG. 6A) may be connected to a positive electrical source. It should be understood that alternatively, the polarity of the connections may be inverted or an alternating voltage may also be used as conventionally known.

Also, referring now to FIGS. 1–6B; it is anticipated that additional coatings of ceramic materials may be applied to the surface of the heaters. The composition of the coatings would comprise commonly known ceramic materials and would be applied in a conventional manner as is well known to those skilled in the art. The coatings could serve the purpose of creating an electrical or chemical barrier for whatever the particular application may require. This may further improve on the inventions' usefulness in certain applications but should not distract from the scope of the invention.

Figure 10:
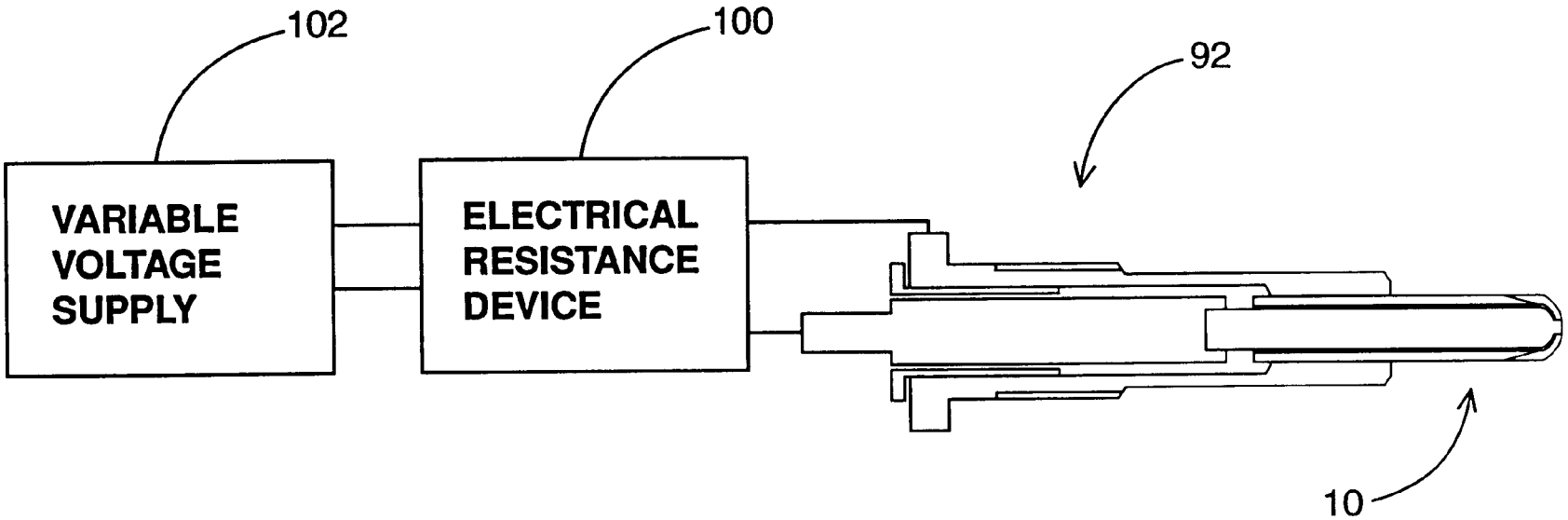
FIG. 10 is a schematic diagram of temperature regulation heating system for enhancing the steady state behaviour of the heater of the present invention.

FIG. 10 shows how any of the heaters of the present invention may be mounted within holder 92 and used in association with an electrical resistance device 100 coupled to a variable power supply 102. This arrangement will enhance the ability of heater 10 (and the other heater embodiments) to maintain a steady operating temperature. Resistance device 100 is used to measure and alter the temperature of heater 10 during operation. Resistance device 100 includes an output to control variable power supply 102. If the measured electrical resistance of heater 10 is lower than a predetermined value, then more power would be provided to heater 10. Alternatively, if the measured electrical resistance of heater 10 is higher than a predetermined value, less power would be provided to heater 10, or essentially heater 10 may be turned off.

The various heater configurations of the present invention are especially well suited to the control method as described since the heaters contain variable materials that react proportionally in resistance value to changes in the temperature of the heated end of the device near the tip 11 of heater 10. It is contemplated that other conventional control methods can also be used to regulate the time and/or temperature of heater 10 that may include conventionally known non-sensing devices such as open loop voltage controllers, duty cycle controllers, on/off controls, pulse width modulation, AC rectifier signals, etc.

As will be apparent to persons skilled in the art, various modifications and adaptations of the structure described above are possible without departure from the present invention, the scope of which is defined in the appended claims.

I claim:

1. A heater having a tip, said heater comprising:

(a) an electrode;

(b) an insulative layer disposed over the outer surface of said electrode;

(c) a resistive layer disposed over said insulative layer such that a substantial portion of the volume of said resistive layer is disposed in close proximity to the tip of the heater; and (d) a conductive layer which is disposed over said insulative layer.

2. The heater of claim 1, having a base portion formed at the first end of said electrode such that the diameter of the base portion is substantially the same as the diameter of the conductive layer.

3. The heater of claim 1, wherein said electrode is electrically conductive.

4. The heater of claim 1, wherein said electrode has a positive temperature coefficient of resistance.

5. The heater of claim 1, wherein said conductive layer has a negative temperature coefficient of resistance.

6. The heater of claim 1, wherein a first portion of said electrode has a resistance that varies with temperature and a second portion of said electrode is electrically conductive, said first portion of the electrode being disposed in close proximity to the tip of the heater and said second portion abutting said first portion in close proximity to the tip of the heater.

7. The heater of claim 6, wherein said first portion has a positive temperature coefficient of resistivity.

8. The heater of claim 6, wherein said second portion has a negative temperature coefficient of resistivity.

9. The heater of claim 6, wherein said second portion is an inner conductive layer disposed between said first portion of electrode and said insulative layer.

10. The heater of claim 9, wherein said inner conductive layer has a negative temperature coefficient of resistivity.

11. The heater of claim 6, wherein said second portion is a conductive core disposed within said electrode.

12. The heater of claim 6, wherein said conductive core has a negative temperature coefficient of resistivity.

13. The heater of claim 1, wherein said resistive layer extends back from the tip of said heater between the insulative layer and the conductive layer along a substantial length of the heater.

14. The heater of claim 1, wherein said resistive layer extends back from the tip of said heater over the insulative layer and the conductive layer along a substantial length of the heater.

15. A ceramic glow plug comprising the heater according to claim 1.

16. The heater of claim 1, wherein said electrode, said insulative layer, said resistive layer, and said conductive layer are all manufactured from ceramic materials.

17. The heater of claim 1, wherein the electrode, the insulative layer, the resistive layer and the conductive layer are slip cast to form a green body.

18. The heater of claim 17, wherein the green body is dipped into conductive ceramic slurry to form the conductive layer.

19. A heating system comprising the heater according to claim 1, wherein an electrical resistance device for measuring the temperature of the heater and having an output is coupled to the heater, and a variable power supply is coupled to the output of the resistance device, said resistance device causing said variable power supply to increase the power provided to said heater if said temperature falls below a first predetermined level and causing said variable power supply to provide less power to said heater if said temperature rises above a second predetermined level.

* * * * *